US007461601B2

(12) United States Patent
Jin et al.

(10) Patent No.: US 7,461,601 B2
(45) **Date of Patent: *Dec. 9, 2008**

(54) FOLD-IN-HALF TABLE

(75) Inventors: Ju-Young Jin, Xiamen (CN); Arvin Patel, Sunnyvale, CA (US)

(73) Assignee: Lifetime Products, Inc., Clearfield, UT (US)

( * ) Notice: Subject to any disclaimer, the term of this patent is extended or adjusted under 35 U.S.C. 154(b) by 105 days.

This patent is subject to a terminal disclaimer.

(21) Appl. No.: 11/134,816

(22) Filed: May 19, 2005

(65) Prior Publication Data

US 2005/0274302 A1 Dec. 15, 2005

Related U.S. Application Data

(63) Continuation-in-part of application No. 29/219,893, filed on Dec. 22, 2004, now abandoned, and a continuation-in-part of application No. 10/668,741, filed on Sep. 23, 2003, now Pat. No. 6,905,166, and a continuation-in-part of application No. 10/616,800, filed on Jul. 10, 2003.

(30) Foreign Application Priority Data

Jul. 10, 2002 (CN) ..... 02 2 63076 U
Sep. 24, 2002 (CN) ..... 02 2 69592 U

(51) Int. Cl.
*A47B 3/00* (2006.01)

(52) U.S. Cl. ..... 108/132; 108/35

(58) Field of Classification Search ..... 108/171, 108/172, 173, 174, 115, 35, 36, 132, 167, 108/168, 169; 297/158.4, 17, 159.1
See application file for complete search history.

(56) References Cited

U.S. PATENT DOCUMENTS

| | | | | |
|---|---|---|---|---|
| 643,511 | A | 2/1900 | Lloyd | |
| 1,614,187 | A | 1/1927 | Coggins | |
| 1,765,766 | A | 6/1930 | Lyon | |
| 1,976,140 | A | 10/1934 | Paul | |
| 2,542,394 | A | 2/1951 | Cohen et al. | |
| 2,619,394 | A | 11/1952 | Mahr | |
| 2,730,418 | A | 1/1956 | Blink | |
| 2,747,957 | A | 5/1956 | Lencioni | |
| 2,781,525 | A * | 2/1957 | Bauer | 5/620 |
| 2,871,076 | A | 1/1959 | Mell | |
| 2,872,259 | A | 2/1959 | Thorpe | |
| 3,143,982 | A | 8/1964 | Blink et al. | |
| 3,368,504 | A | 2/1968 | Cohen | |
| 3,656,439 | A | 4/1972 | Domin | |

(Continued)

*Primary Examiner*—José V Chen
(74) *Attorney, Agent, or Firm*—Workman Nydegger

(57) ABSTRACT

A foldable table may include a table top and legs that are movable between an extended position and a collapsed position. The table top may be divided into a first section and a second section, and a hinge assembly may connect the first section of the table top to the second section of the table top to allow the table top to be selectively moved between a folded position and an unfolded position. The hinge assembly may include a locking member that may be sized and configured to lock the hinge assembly in a fixed position. In addition, the hinge assembly may include a lever that is sized and configured to move the locking member between a locked and unlocked position.

17 Claims, 9 Drawing Sheets

U.S. PATENT DOCUMENTS 3,866,913 A 2/1975 Zimmers et al.
4,005,898 A 2/1977 Way
D247,080 S 1/1978 Robinson
4,089,522 A 5/1978 Rock
4,133,271 A * 1/1979 Carlson ..... 108/174
4,489,661 A 12/1984 Fitzgerald
4,653,804 A 3/1987 Yoo et al.
4,841,877 A 6/1989 Virtue
4,883,314 A 11/1989 Sakong
4,911,085 A 3/1990 Pencoske
5,009,170 A 4/1991 Spehar
5,154,441 A 10/1992 White et al.
5,357,872 A 10/1994 Wilmore
5,377,601 A 1/1995 Cashen
5,381,740 A 1/1995 Johnston
5,421,272 A 6/1995 Wilmore
5,501,157 A 3/1996 Westerburgen
5,730,066 A 3/1998 Auten et al.
D414,626 S 10/1999 Collins et al.
5,983,807 A 11/1999 Tarnay et al.
6,000,345 A 12/1999 Gillotti
D420,527 S 2/2000 Pinch
6,032,585 A 3/2000 Pinch
6,058,853 A 5/2000 Pinch
6,112,674 A 9/2000 Stanford
6,334,400 B1 1/2002 Nien
6,454,357 B1 9/2002 Foulger
D468,135 S 1/2003 Ashby et al.
D479,778 S 9/2003 Haney et al.
6,684,426 B1 2/2004 Lin
6,752,091 B2 6/2004 Glover et al.
6,905,166 B2 6/2005 Zhurong et al.
7,278,361 B2 10/2007 Zhurong et al.
2002/0092445 A1 7/2002 Glover et al.

* cited by examiner

FOLD-IN-HALF TABLE

CROSS-REFERENCE TO RELATED APPLICATIONS

This application is a continuation-in-part of U.S. patent application Ser. No. 10/616,800, filed Jul. 10, 2003, and entitled FOLDING TABLE. This application is continuation-in-part of U.S. patent application Ser. No. 10/668,741, filed Sept. 23, 2003, entitled PICNIC TABLE, now U.S. Pat. No. 6,905,166. This application is a continuation-in-part of U.S. design patent application 29/219,893, filed Dec. 22, 2004 now abandoned, entitled LOCKING HINGE, now abandoned. All of these applications are incorporated by reference in their entireties.

BACKGROUND OF THE INVENTION

1. Field of the Invention

The present invention generally relates to furniture and, in particular, to tables.

2. Description of Related Art

Many different types of tables are well known and used for a variety of purposes. For example, many conventional tables may include legs that are pivotally attached to the table top and the legs may be movable between a use position in which the legs extend outwardly from the table top and a storage position in which the legs are folded against the table top. These known tables may also have a length of about six to eight feet. Conventional tables with folding legs and a length of about six or eight feet are often referred to as "banquet tables" and these tables are often used in assembly halls, banquet halls, convention centers, hotels, schools, churches and other locations where large groups of people meet. These tables can often be positioned in an assortment of different configurations and used in a variety of settings because of the folding legs. In addition, when the tables are no longer needed, the tables can be relatively easily moved or stored by folding the legs into the collapsed position.

The ability to collapse the legs on a conventional banquet table allows the table to be more conveniently stored. Even when the legs are collapsed, however, the table top retains its same size and shape. For example, many banquet tables have a length of six to eight feet and a width of four feet. As a result, the storage of conventional banquet tables, even with the legs in the collapsed position, still requires a relative large storage area. This large storage area may create a significant problem, especially if more than one table needs to be stored. In addition, it is often desirable to have or use one or more banquet tables at smaller facilities such as restaurants, offices or homes where the tables may be used less frequently or only for special occasions. Disadvantageously, conventional banquet tables, even when the legs are folded, are often too large and obstructive to be conveniently stored at such smaller facilities. As a result, it is often necessary to rent or borrow the banquet tables for other locations when needed. This process can be inconvenient, time consuming and costly.

Furthermore, transporting conventional banquet tables can be problematic. For example, conventional banquet tables may be very difficult to move by a single person because of the length of the table. As such, two or more people are often required the tables. In addition, the extended length of many conventional banquet tables often precludes them from being transported in the trunk or back seat of a car. Thus, many conventional banquet tables must be transported by a truck or trailer. Again, this can be problematic for those not having access to a truck or trailer.

Conventional tables may also a tabletop that is movable between a folded position and an unfolded position. In particular, known tables may include a table top with a first half that is connected to a second half by hinges. Many of these known tables with a foldable tabletop, however, are unstable and/or unable to support a significant amount of weight. For example, many conventional tables with foldable table tops can include one or more weak or unsupported portions where the sections of the table top are connected. This may allow one or both sides of the table top to sag. In order to prevent this undesirable sagging of the table top, conventional folding tables may include table tops that are constructed from stronger and thicker materials. This, however, may increase the weight of the table and make it more difficult to carry and move.

Known tables with foldable table tops are often difficult to move and store because the table top may unintentionally open and swing between the folded and unfolded positions as the table is being moved, stacked or stored. Additionally, conventional tables may allow the legs to unintentionally move from the collapsed to the extended position when the table is being moved, stacked or stored. Further, known tables with foldable table tops are often difficult to move, stack or store because it is difficult to grasp the folded table top. In particular, the folded table top may not include any convenient handholds. To exacerbate this problem, attempting to pick up these known tables in the wrong way can cause the table to unintentionally unfold.

An additional shortcoming of conventional tables with foldable tabletops is the hinges may be connected to the sections of the table top by a plurality of screws. Disadvantageously, the structural integrity of the table top may be decreased by the numerous holes created by the plurality of screws, which may allow the table top to undesirably collapse and fail. In addition, because the screws are typically individually attached to the table top, the time required to construct the table may be significantly increased.

BRIEF SUMMARY OF THE INVENTION

A need therefore exists for a table that reduces or eliminates the above-described and other disadvantages and problems.

One aspect is a table that may include legs which can be selectively moved between a collapsed position and an extended position relative to a table top. Advantageously, when the legs are in the collapsed position, the table may be more easily moved, transported and/or stored.

Another aspect is a table that may include a table top which can be selectively moved between a folded position and unfolded position. For example, the table top may include a first portion that is movable relative to a second portion. In particular, the table top may include a first portion that is pivotally connected to a second portion. When the table top is in the unfolded position, the table top preferably allows a strong, sturdy and secure table to be created. Advantageously, the strong, sturdy and secure table may be used to support a wide variety of objects and for many different purposes.

Still another aspect is a table that may include a table top which can be selectively moved between folded and unfolded positions, and legs which can be selectively moved between a collapsed position and an extended position relative to a table top. Advantageously, when the table top and legs are in the folded or collapsed positions, the table may be easy to move, transport and store. In particular, this may allow the table to be easily moved by a single person, stored in a much smaller area than conventional tables and/or transported in the backseat or trunk of an automobile.

Yet another aspect is a table that may include a table top which is constructed from blow-molded plastic. Significantly, the blow-molded plastic table top may be lightweight, which may allow a lightweight table to be constructed. Additionally, the blow-molded plastic table top may be easily formed into any desired configuration, shape, size and design depending, for example, upon the intended use and/or configuration of the table. The blow-molded plastic table top may also be generally weather resistant and temperature insensitive, which may allow the table to be used in a variety of locations and environments. In addition, the blow-molded plastic table top may be durable, long-lasting and it generally does not corrode, rust or otherwise deteriorate over time. Further, because the blow-molded plastic table top may be relatively strong, the table may be used to support a relatively large amount of weight. Significantly, the blow-molded plastic table top may form a structural member of the table or the table top may be supported by a frame.

Advantageously, the blow-molded plastic table top may be relatively strong because it may include two or more opposing walls or surfaces that are separated by a given distance. The opposing walls may help create a high-strength, rigid table top. Preferably, the opposing walls or surfaces are separated by a generally constant distance so that the table top has generally uniform characteristics, but the table top could have any suitable shape, configuration or design. In addition, because the table top may include a hollow interior portion that is formed during the blow-molding process, that may allow a lightweight table top to be created. Thus, the table may include a blow-molded table top that is both lightweight and strong.

Another aspect is a table that may include a foldable table top. The foldable table top may have a first section and a second section with inner edges that include engaging portions and receiving portions. For example, the inner edges of the first and second sections of the table top may have a tongue or groove that aligns with a corresponding tongue or groove on the other edge. The tongues and grooves preferably interlock when the table top is in the unfolded position. As a result, the table top may have increased strength when the table top is in the unfolded position. The increased strength of the interlocking features may allow the table top to be constructed from a lighter material without sacrificing strength or integrity. In particular, this may allow a blow-molded table top with thinner outer walls be used to create the foldable table top.

Still another aspect is a table that may include a handle which can be mounted to a portion of the table top such that the handle may project outwardly when the table top is in the folded position. Significantly, this may allow an individual to gasp the projecting handle and easily carry the table. In addition, the table may include a handle retention assembly which may secure the handle in a generally fixed position, which is preferably out of the way and not in an obstructive position, when the table is in the unfolded position.

Yet another aspect is a table that may be easily assembled and/or disassembled because it does not include any heavy or complex mechanisms to attach the legs to the table top or to connect the table top sections. For example, the table may include a frame and the frame may include two elongated side rails that are connected to the table top. In particular, the side rails may be connected to an outer lip of the table top and/or frame mounting portions, which may be integrally formed in the table top.

Still yet another aspect is a table that may include a foldable table top and foldable legs which can be manufactured quickly and easily. In particular, the table may include relatively few components and the components may be quickly and easily assembled. Further, the straight forward design and attachment of the components may allow the table to be shipped either assembled or unassembled, and it may allow retailers or consumers to assemble the table if desired.

A further aspect is a table that may include hinges which are directly mounted to the side rails of the frame to allow the table top to be moved between the folded and unfolded positions. Because the hinges may be mounted directly to the side rails of the frame, the hinges do not have to be separately mounted directly to the table top by screws or other fasteners. This may allow a strong and more sturdy table top to be constructed.

A still further aspect is a table that may include a foldable table top with a locking mechanism to secure the table top in a fixed position. For example, the table may include a bolt that can be moved between locked and unlocked positions. When the table top is in the unfolded position, the bolt may selectively lock the hinge assembly and/or portions of the frame in a generally fixed position. As a result the table top may be stable and can be easily moved when in the unfolded position without risk of the table top unintentionally folding.

Another aspect is a table that may include a retainer that secures the table top in the folded or collapsed position. For example, one end of the retainer may be mounted to a first portion of the table, such as a cross member. The other end of the retainer may be connected to a second portion of the table, such as another cross member. The retainer may help retain the table top in the folded position so that it does not unintentionally unfold when the table is being carried, transported and/or stored. Advantageously, the retainer may be sized and configured to automatically engage secure the table top in the folded position. In addition, the retainer may be selectively and/or securely connected to either or both the first and second portions of the table.

Still another aspect is a table that may include braces that are sized and configured to support the legs. In particular, the braces may be sized and configured to support and hold the legs in a generally fixed position.

These and other aspects, features and advantages of the invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF PREFERRED EMBODIMENTS

The present invention is generally directed towards fold-in-half tables. The principles of the present invention, however, are not limited to fold-in-half tables. It will be understood that, in light of the present disclosure, the tables and various components of the tables disclosed herein can be successfully used in connection with other types of furniture and structures.

Additionally, to assist in the description of the fold-in-half tables, words such as top, bottom, front, rear, right and left are used to describe the accompanying figures. It will be appreciated, however, that the fold-in-half tables can be located in a variety of desired positions—including various angles, sideways and even upside down. A detailed description of the fold-in-half tables now follows.

Figure 1:
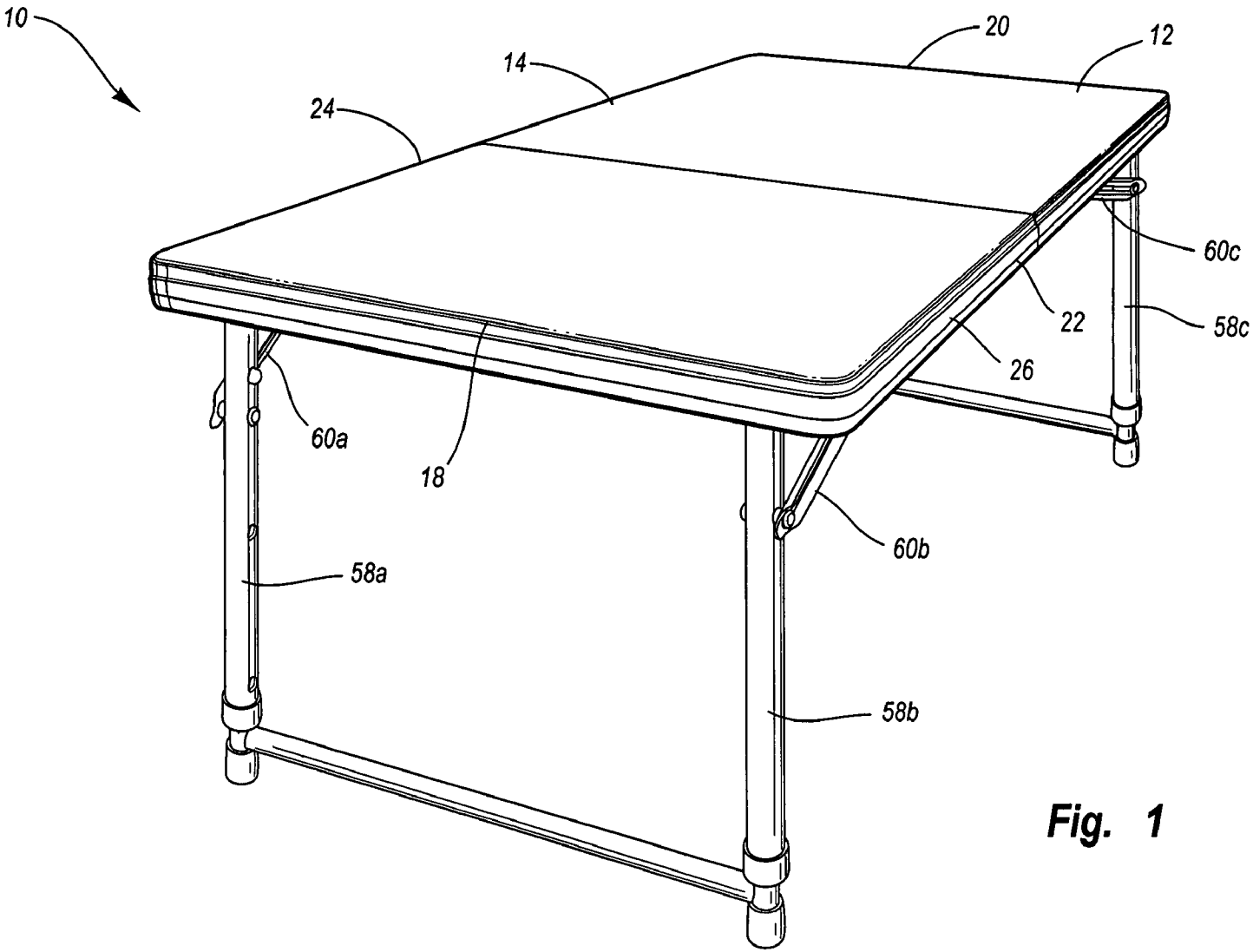
FIG. 1 is an upper perspective view of an exemplary embodiment of a table, illustrating the legs in an extended position.

An exemplary embodiment of a table 10 is shown in FIG. 1 and it includes a table top 12 with an upper surface 14, a lower surface 16, a first end 18, a second end 20, a front side 22 and a rear side 24. The upper surface 14 of the table top 12 is preferably relatively planar to create a generally smooth, flat working surface, but the upper surface could also be textured and have other suitable configurations depending, for example, upon the intended use of the table 10. The table top 12 may also include an edge 26 that is disposed about the outer perimeter or periphery of the table top. All or a portion of the edge 26 may be beveled, sloped or rounded to, for example, increase the comfort and safety of the user.

The table top 12 may also include a downwardly extending lip 28 disposed near or at the outer portion of the table top. The lip 28 preferably extends downwardly beyond the lower surface 16 of the table top 12 and the lip may be aligned with or form a part of the edge 26 of the table top. It will be appreciated that the lip 28 may also be spaced inwardly from the edge 26 of the table top 12.

The table top 12 preferably has a generally rectangular configuration with rounded corners and slightly rounded edges 26. Desirably, the table top 12 has a relatively large size and it is configured for use as a banquet style table. In particular, the table top 12 may have a length of about five feet (about 1.5 meters) and a width of about two and one-half feet (about 0.75 meters). One skilled in the art will appreciate that the table top 12 can be larger or smaller according, for example, to the intended use of the table 10. Additionally, the table top 12 may have other suitable shapes and configurations such as square, circular, oval, and the like depending, for example, upon the intended use of the table 10. In addition, the corners and edges 26 of the table top 12 do not have to be rounded and the corners and edges could have any desirable configuration, but the rounded features may increase the comfort and/or safety of the user. Further, the table top 12 could be sized and configured for use with other types of tables such as utility tables, card tables, personal-sized tables, and the like.

The table top 12 is preferably constructed from a lightweight material such as plastic. In particular, the table top 12 may be constructed from high density polyethylene, but the table top may be constructed from any materials with suitable characteristics. The plastic table top 12 is desirably formed by a blow-molding process because, for example, it may allow a strong, lightweight, rigid and/or sturdy table top to be quickly and easily manufactured. Other suitable molding processes, such as rotational molding and injection molding, can also be used. Advantageously, the blow-molded plastic table top 12 may have a lighter weight that conventional table tops constructed from materials such as wood or metal. The blow-molded plastic table top 12 may also be lightweight because it may include a hollow interior portion that is formed during the blow-molding process.

Furthermore, the table top 12 is preferably constructed from blow-molded plastic because the blow-molded plastic table top may be relatively durable, weather resistant, temperature insensitive, corrosion resistant, rust resistant and blow-molded plastic generally does not deteriorate over time. One skilled in the art, however, will appreciate that the table top 12 does not have to be constructed from blow-molded plastic and other suitable materials and/or processes can be used to construct the table top. For example, the table top 12 may be constructed from other materials with sufficient strength and desirable characteristics such as plywood, particle board, solid wood, wood slates, metal alloys, fiberglass, ceramics, graphite, and the like.

The upper surface 14 and the lower surface 16 of the table top 12 are preferably spaced apart a given distance and these two spaced apart surfaces may help create a rigid and strong table top 12. Preferably, the upper surface 14 and the lower surface 16 are separated by a generally constant distance so that the surfaces are generally aligned in parallel planes. Advantageously, this may help create a table top 12 with generally uniform characteristics, but the table top could have other suitable arrangements and configurations.

Figure 2:
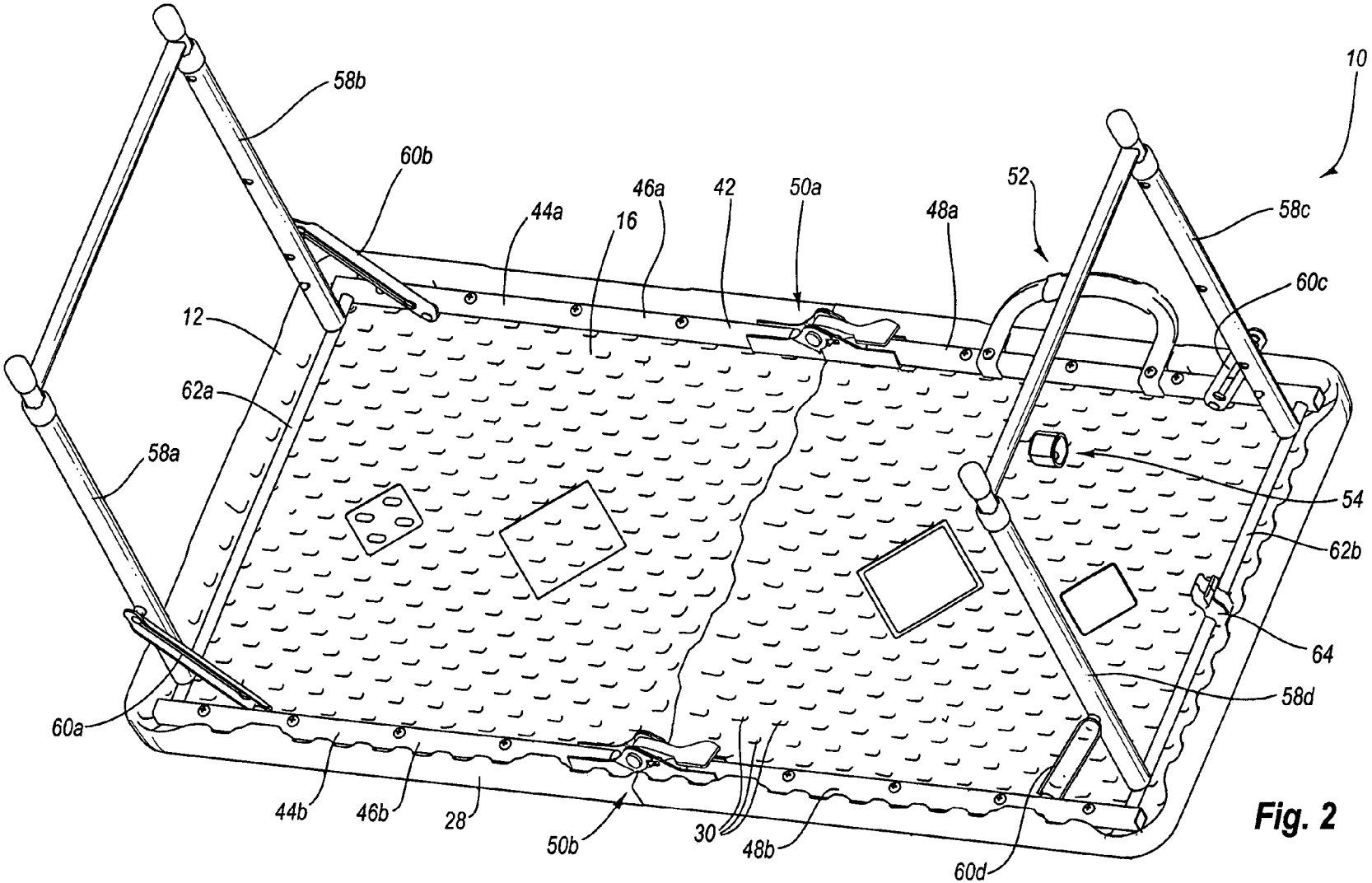
FIG. 2 is a lower perspective view of table shown in FIG. 1.

As shown in FIG. 2, the table top 12 may include one or more tack-offs, kiss-offs or depressions 30. The depressions 30 may extend from one surface to another surface and the ends of the depressions may contact the opposing surface, if desired. Advantageously, the depressions 30 may be sized and configured to further increase the strength and rigidity of the table top 12. The depressions 30 may also be integrally formed as part of table top 12, such as during the blow-molding or other molding processes, or can be formed or attached separately. One of ordinary skill in the art will appreciate that the depressions 30 are not required.

In greater detail, the depressions 30 are preferably located in the lower surface 16 of table top 12 and the depressions are preferably sized and configured to increase the strength and structural integrity of the table top. For example, the depressions 30 may extend towards the upper surface 14 of the table top 12 and the ends of the depressions may contact or engage a bottom portion of the upper surface of the table top. On the other hand, the ends of the depressions 30 may be spaced from the upper surface of the table top 12. In addition, the depressions 30 may cover substantially the entire lower surface 16 of the table top 12, but it will be appreciated that the depressions may cover only a portion of the table top. Additionally, while the depressions 30 are shown and described as being located in the lower surface 16 of the table top 12, it will be appreciated that the depressions could be formed in any desired portion of the table top. For instance, it will be appreciated that one or more depressions 30 may be formed in the upper surface 14 of the table top 12 and one or more depressions may be formed in the lower surface 16 of the table top 12, and these opposing depressions may be generally aligned. At least a portion of these opposing depressions 30 may contact or engage each other, but the opposing depressions do not have to touch or engage.

The depressions 30 can be arranged into a predetermined pattern or array in order to increase the strength and structural integrity of the table top 12. In particular, the depressions 30 are preferably spaced closely together in a predetermined pattern such that the distance between the depressions is minimized. Advantageously, minimizing the distance between the depressions 30 may minimize the unsupported areas of the upper wall of the table top 12, which may increase the smoothness of the upper surface 14 of the table top. In addition, minimizing the distance between the depressions 30 may increase the structural integrity and strength of the table top 12. Thus, the depressions 30 are desirably closely spaced on the lower surface 16 of the table top 12 such that the depressions are separated by a minimum distance in order to create a table top with greater strength, structural integrity and an upper surface 14 with increased smoothness.

Advantageously, the increased structural integrity and strength of the table top 12 may allow the thickness of the table top 12 to be decreased, which may allow less plastic to be used to construct the table 10. Because less plastic may be required to construct the table top 12, that may allow the cost of the table 10 to be decreased. In addition, the blow-molded table top 12 may cool more quickly during the manufacturing process because of the thinner outer walls. This may allow the table top 12 to be removed from the manufacturing mold more quickly and it may allow the table top to be removed at a higher temperature because it dissipates heat much more rapidly. Significantly, because the cycle time required to construct the table top 12 may be decreased, the manufacturing efficiency may be increased.

The depressions 30 are also preferably arranged in a predetermined pattern with a generally constant and uniform spacing so that the table top 12 has generally uniform characteristics. In particular, the depressions 30 are preferably arranged into a uniform pattern across the entire surface of the table top 12 so that the strength, structural integrity and/or other characteristics of the table top are generally uniform throughout the table top. Thus, the table top 12 has fewer, if any, weak or unsupported portions which decrease the strength and structural integrity of the table top. Thus, the depressions 30 may be used to create a table top 12 with generally uniform characteristics throughout the table top.

Advantageously, various features that are formed in or attached to the table top 12 may be sized and configured such that they do not significantly disturb or disrupt the desired pattern of depressions 30. Additional details regarding the size, shape and configuration of depressions 30 that may be suitable for use in connection with the table top 12 are disclosed in Assignee's depending U.S. Pat. No. 7,069,865. entitled HIGH-STRENGTH, LIGHTWEIGHT BLOW-MOLDED PLASTIC STRUCTURES, which is incorporated by reference in its entirety. It will be understood, however, that the depressions 30 are not required.

As shown in FIG. 2, the lip 28 is preferably disposed near or at the outer portion of the table top 12. As discussed above, the lip 28 preferably extends downwardly beyond the lower surface 16 of the table top 12 and the lip may be aligned with or form part of the edge 26 of the table top, but the lip may also be spaced inwardly from the edge of the table top 12. The lip 28 may include an inner surface, an outer surface and a lower surface, and the lip preferably has a generally hollow interior. Advantageously, the lip 28 may be integrally formed during the blow-molding process as part of table top 12 as part of a unitary, one-piece construction. It will be appreciated, however, that the lip 28 does not have to be formed as a unitary component of the table top 12.

The lower surface of the lip 28 desirably has a generally smooth, planar surface that facilitates stacking of the tables 10. The inner surface of the lip 28 desirably includes a number of serrations, notches, ribs, and/or struts that are sized and configured to increase the strength, rigidity and/or flexibility of the lip 28. In particular, the inner surface of the lip 28 may include a number of notches, indentations, grooves or other inwardly extending portions to form an uneven or saw-tooth type surface. The inner surface may also include a number of bumps, humps, protrusions or other outwardly extending portions to form an uneven or saw-tooth type surface. The inner surface of the lip 28 may also contain a combination of inwardly and outwardly portions to form the uneven or saw-tooth type surface. One of ordinary skill in the art will appreciate that the lip 28 may have a variety of suitable configurations and arrangements, such as disclosed in U.S. Pat. No. 7,111,563, entitled EDGE AND CORNER FOR A TABLE TOP, which is incorporated by reference in its entirety. It will be understood, however, that the lip 28 is not required.

It will also be understood that other features of the table top 12 may also be integrally formed with table top 12. For example, the depressions 30 and various mounting portions, clips, and receiving portions may be integrally formed with table top 12. Because these features may be integrally formed in the table top 12, that may expedite the manufacturing process. These features, however, do not have to be integrally formed in the table top 12 and they could be attached to the table top by any suitable methods or devices.

Figure 3:
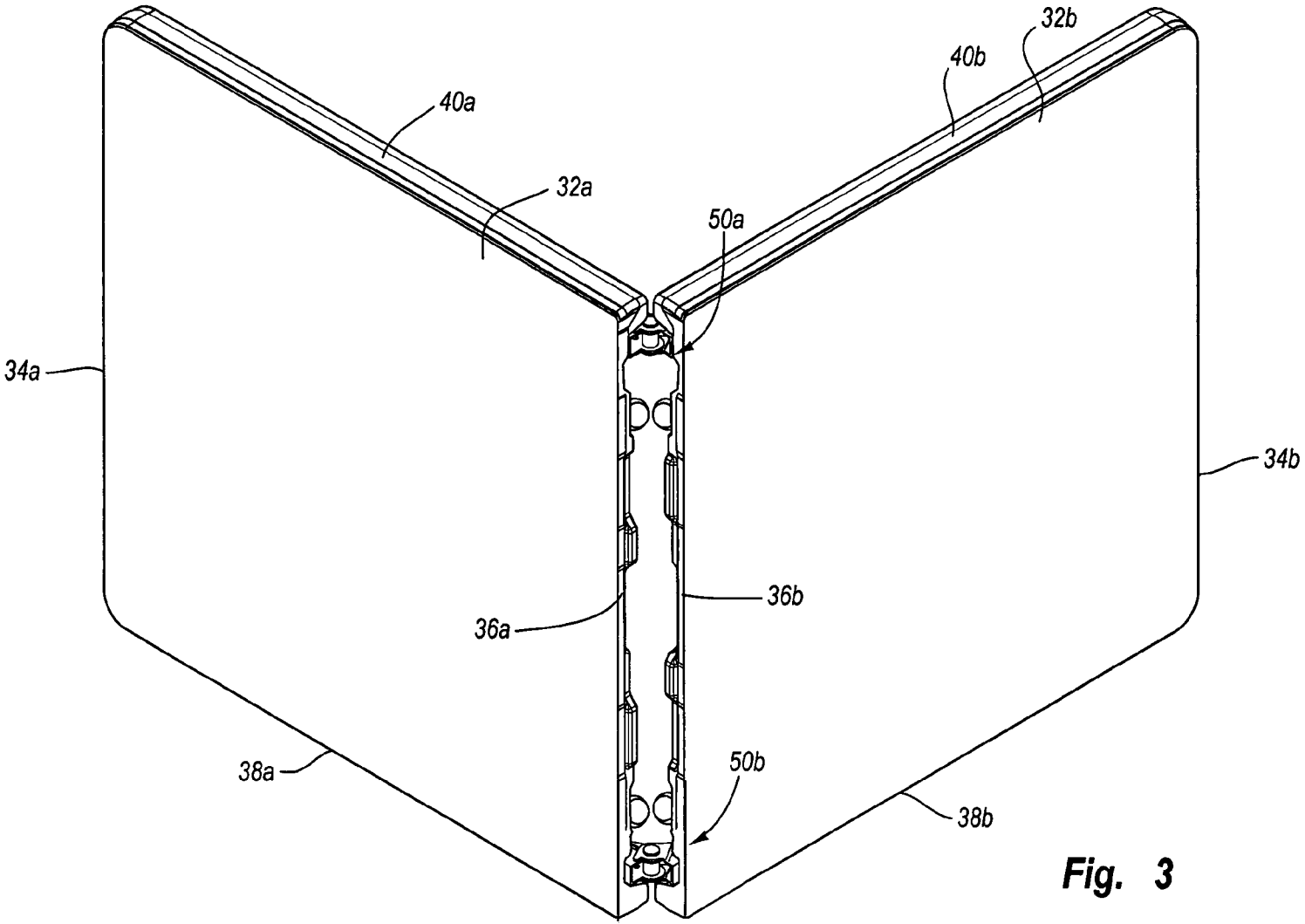
FIG. 3 is a perspective view of the table shown in FIG. 1, illustrating the table top in a partially folded position.

As best seen in FIG. 3, the table top 12 may include a first section 32*a* and a second section 32*b*. The first and second sections 32*a*, 32*b* may respectively include an outer edge 34*a*, 34*b*; an inner edge 36*a*, 36*b*; and side 38*a*, 38*b* and 40*a*, 40*b*. The first and second sections 32*a*, 32*b* of the table top 12 may be formed, for example, as separate and discrete members or as a unitary, one-piece table top that is cut into sections.

Figure 4:
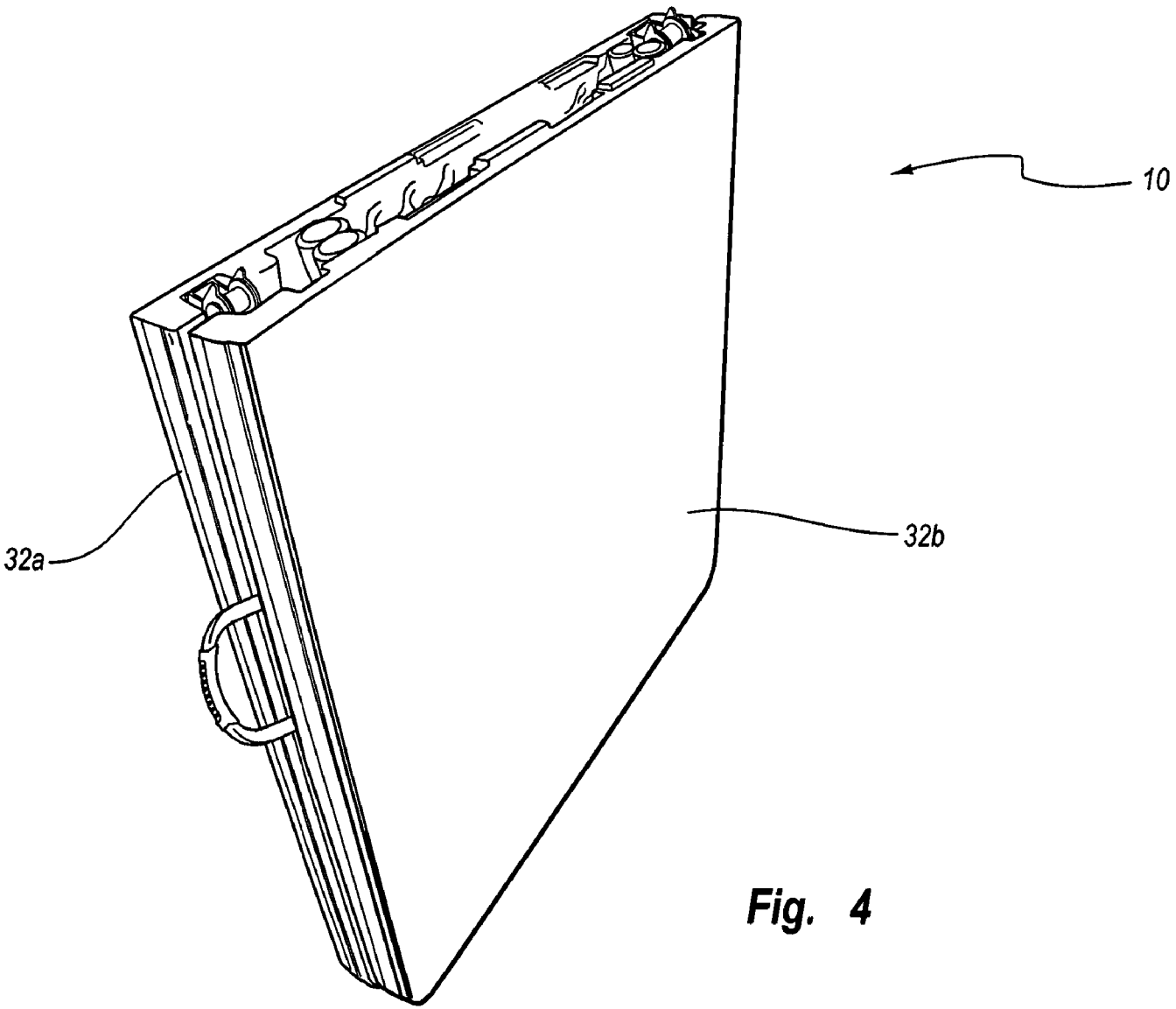
FIG. 4 is a perspective view of the table shown in FIG. 1, illustrating the table top in a fully folded position.
Figure 5:
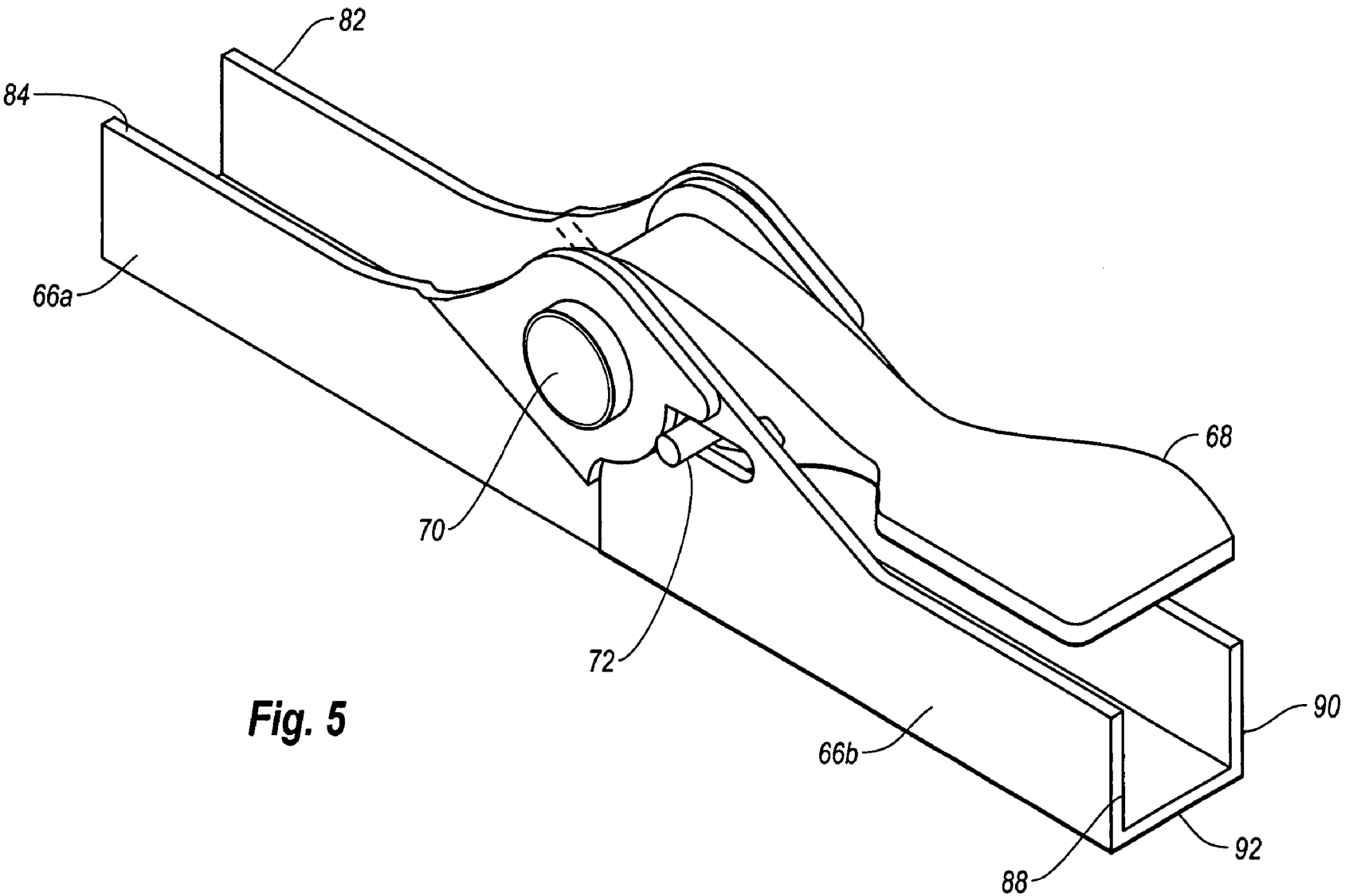
FIG. 5 is a perspective view of an exemplary embodiment a hinge assembly that may be used in connection with the exemplary table shown in FIG. 1.

The first section 32*a* and the second section 32*b* of the table top 12 may be moved between the folded position as seen in FIG. 4 and the unfolded position as seen in FIG. 1. In addition, the inner edges 36*a*, 36*b* of the first section 32*a* and second section 32*b* may include an upper portion and a lower portion. The lower portion may include one or more receiving portions, such as grooves, and/or one or more outwardly extending portions, such as tongues. Preferably, the outwardly extending portions of the first section 32*a* are aligned with corresponding receiving portions of the second section 32*b*. Similarly, the outwardly extending portions of the second section 32*b* are preferably aligned with corresponding receiving portions of first section 32*a*. As a result, when table top 12 is moved into the folded position, the outwardly extending portions are received within the corresponding receiving portions, thereby interlocking the table top sections 32*a*, 32*b*. Advantageously, this interlocking may provide increased rigidity along the inner edges 36*a*, 36*b* so as to help prevent unwanted bending and/or sagging of the table top 12. It will be appreciated that the outwardly extending portions and the inwardly extending portions can have a variety of suitable sizes, shapes and configurations. The outwardly extending portions and the inwardly extending portions, however, are not required.

As shown in FIG. 2, table 10 may include a frame 42 that is connected to the lower surface 16 of the table top 12. The frame 42 may include two side rails 44*a*, 44*b* that extend along all or at least a portion of the length of the table top 12, and the frame may be sized and configured to help support at least a portion of the table top. The side rails 44 are preferably positioned near the opposing edges 26 of the table top and, in particular, the side rails are preferably disposed proximate the lip 28. It will be appreciated that the frame 42 and/or the side rails 44*a*, 44*b* may be spaced inwardly from the lip 28, if desired.

The frame 42 is desirably constructed from metal, which may easily be formed into the desired configuration by known operations, such as stamping and bending, and the metal may be coated or painted as desired. The frame 42 may also include one or more end rails attached to the ends of the side rails 44 and the frame may provide attachment points for the legs, as discussed in more detail below. While the frame 42 preferably includes two side rails 44 that are generally aligned in a parallel configuration, it will be appreciated that the frame may have other suitable configurations and arrangements depending, for example, upon the size and shape of the table top 12 or the intended use of the table 10. For example, other suitable embodiments of the frame 42 may be disclosed in U.S. Pat No. 7,178,471, entitled TABLE WITH FRAME THAT CAN BE ATTACHED TO THE TABLE TOP WITHOUT MECHANICAL FASTENERS, which is incorporated by reference in its entirety.

In greater detail, as seen in FIG. 2, the side rails 44*a*, 44*b* may include a first portion 46*a*, 46*b* mounted to first table top section 32*a*; and a second portion 48*a*, 48*b* mounted to the second table top section 32*b*. A first hinge assembly 50*a* is preferably connected to the first portion 46*a* and the second portion 48*a*, and a second hinge assembly 50*b* is preferably connected to the first portion 46*b* and the second portion 48*b*. The hinge assemblies 50*a*, 50*b* may each include a pair of brackets that are mounted to the rail portions 46, 48. In addition, the hinge assemblies 50*a*, 50*b* may be pivotally coupled (or otherwise connected) using, for example, a pin. The pin can consist of a bolt, rivet, rod and the like. In addition, the hinge assemblies 50*a*, 50*b* may be connected to the rail portions 46, 48 by welding, adhesive, crimping, mechanical fasteners such as bolts or screws, and the like. All or a portion of the hinge assemblies 50*a*, 50*b* may also be integrally formed with the rail portions 46, 48. The hinge assemblies 50*a*, 50*b* may allow the table top 12 to be selectively moved between the folded and unfolded positions.

As shown in FIG. 2, the table 10 may include a handle 52. The handle 52 may be mounted to a portion of the table top 12 such that the handle may project between the edges of the sections of the table top when the table top is in the folded position. In this configuration, an individual may easily gasp the projecting handle to carry the table. Furthermore, a handle retention assembly 54 may be provided. The handle retention assembly 54 may advantageously secure the handle in a generally fixed and unobtrusive location when the table top 12 is in the unfolded position. It will be appreciated that the handle 52 and/or retention assembly 54 may have other suitable locations and configurations.

As shown in FIG. 2, the side rails 44 of the frame 42 may include openings that are sized and configured to allow legs 58*a*, 58*b*, 58*c*, 58*d* to be attached to the table 10. The legs 58 are preferably sized and configured to support the table top 12 above a surface such as a floor and the legs may be adjustable in length, if desired. The legs 58 are preferably disposed between the side rails 44 of the frame 42, and the openings are preferably located near the ends of the side rails 44 in generally aligned pairs. The table 10 may include one or more connecting rods 62*a*, 62*b* that are sized and configured to be inserted into the openings in the side rails 44 of the frame 42. The rotation of the connecting rods 62 within the openings may allow the legs 58 to move between the extended and collapsed positions relative to the table top 12. It will be appreciated that the openings could be positioned in any desired locations depending, for example, the configuration of the legs 58 and/or the frame 42, and the legs could be attached to the table 10 in any suitable manner or method. Additionally, as shown in FIG. 2, a pair of legs 58 may be interconnected to permit the legs to move simultaneously; however, the legs need not be interconnected and the legs may independently move. It will further be appreciated that the legs 58 need not be in pivotal engagement with frame 42 or the table top 12 to be collapsible. The legs 58 may also be detachably connected to the table top 12 such that when it is desired to collapse the table 10 for storage, the legs are detached from the table top 12. The legs 58, frame 44 and other portions of the table 10 may have various suitable configurations and arrangements, such as disclosed in U.S. Pat. No. 7,100,518, entitled PIVOTAL CONNECTION OF A TABLE LEG TO A FRAME, which is incorporated by reference in its entirety.

As shown in FIGS. 1 and 2, the legs 58 may be supported by one or more braces. In particular, each leg 58*a*, 58*b*, 58*c*, 58*d* may be supported by a brace 60*a*, 60*b*, 60*c*, 60*d*, respectively.

Advantageously, the braces 60 may secure the legs 58 in the extended position. The braces 60, for example, may include a slotted brace with a pin that moves within the slot. The braces 60 may also include a biasing member, such as a spacer or washer, that may be used to bias (or provide a force against) the slotted brace. Advantageously, the force may be used to releasably lock the brace 60 in a generally fixed position. The braces 60 may have a variety of suitable configurations, such as disclosed in U.S. patent application 11/112,236, which was filed on Apr. 22, 2005, and entitled BRACE ASSEMBLY FOR A TABLE LEQ which is incorporated by reference in its entirety.

The table 10 may include one or more retainers 64. For example, as shown in FIG. 2, a first end of the retainer 64 is connected to the first portion 32*a* of the table top 12. In particular, the first of the retainer 64 is connected to the connecting rod 62*b*. The second end of the retainer 64 is preferably sized and configured to engage the second portion 32*b* of the table top 12, such as the connecting rod 62*a*, when the table top is moved into the folded position. Preferably the retainer 64 is releasably connected to the second portion 32*b* of the table top 12 to retain the table top in folded position, but it allows the table top to also be unfolded. Thus, the retainer 64 may help prevent the table top 12 from unintentionally being unfolded when the table 10 is being carried, transported and/or stored. Advantageously, the retainer 64 may be sized and configured to automatically secure the table top 12 in the folded position. In addition, the retainer 64 may be permanently or selectively connected to each the first portion 32*a* and/or the second portion 32*b* of the table 12 depending, for example, upon the intended use of the table 10. The retainer 64 may also have a variety of suitable configurations and arrangements, such as disclosed in U.S. patent application Ser. No. 11/112,075, which was filed Apr. 22, 2005, and entitled FOLD RETAINER FOR SECURING A TABLE IN A FOLDED POSITION, which is incorporated by reference in its entirety.

In addition, as discussed above, the table 10 may include hinge assemblies 50*a*, 50*b* and each hinge assembly may include brackets 66*a*, 66*b*. As shown in FIGS. 5 to 7D, the table 10 may also include a locking lever 68 with a large handles that provides a large surface area for a user to manipulate the lever. The lever 68 may move between a first position, such as seen in FIG. 7A, in which the hinge assembly is locked in a generally fixed position and a second position, such as seen in FIG. 7B, in which the hinge assembly may be readily moved. Thus, the hinge assemblies 50*a*, 50*b* may be used to allow the table top 12 to be moved between a locked position in which the first and section sections 32*a*, 32*b* of the table top are generally aligned and the table 10 is configured to be used, and an unlocked position in which the first and second sections of the table top can be readily moved into different positions.

Figure 7A:
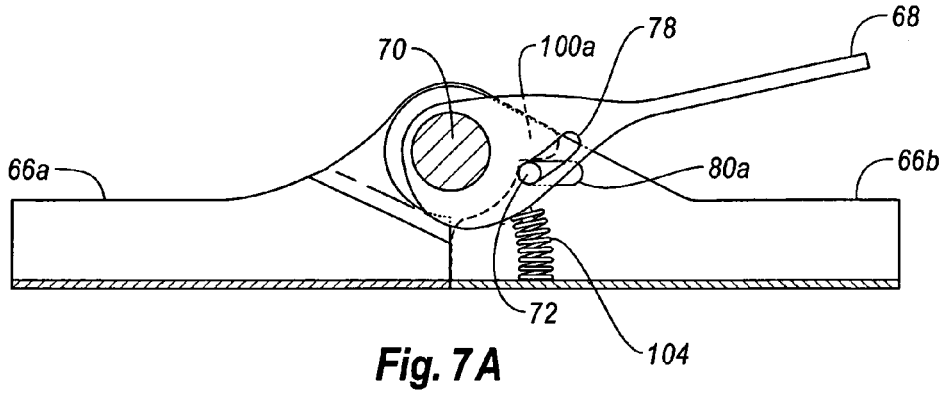
FIG. 7A is a cutaway side view of the hinge assembly shown in FIG. 5, illustrating the hinge assembly in a locked position.
Figure 7B:
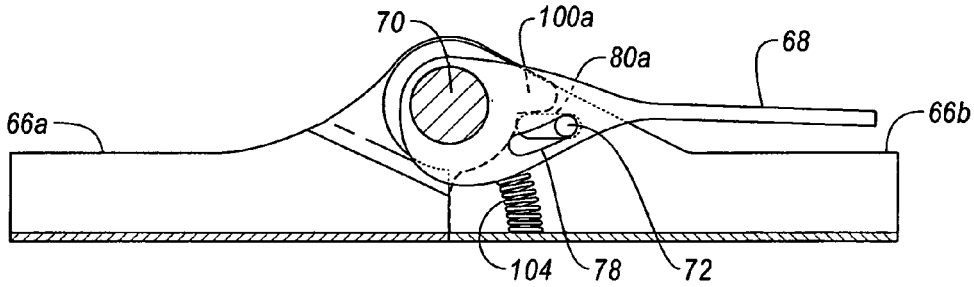
FIG. 7B is a cutaway side view of the hinge assembly shown in FIG. 5, illustrating the hinge assembly in an unlocked position.
Figure 7C:
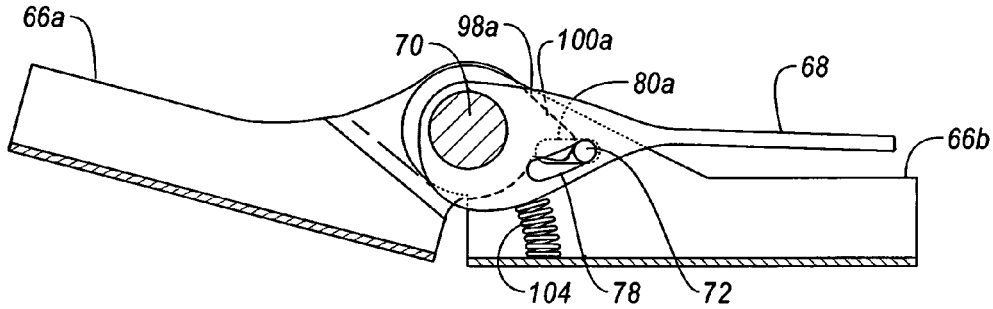
FIG. 7C is a cutaway side view of the hinge assembly shown in FIG. 5, illustrating the hinge assembly in a partially folded position.
Figure 7D:
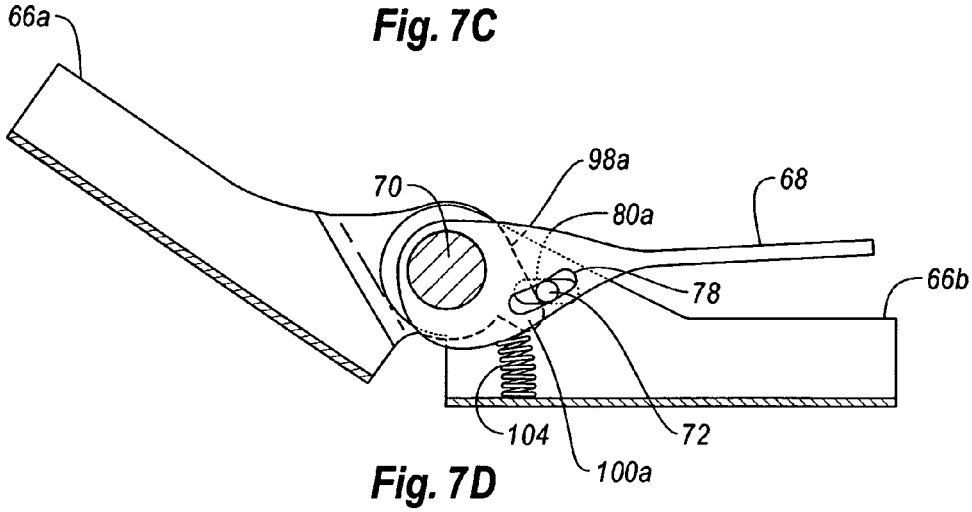
FIG. 7D is a cutaway side view of the hinge assembly shown in FIG. 5, illustrating the hinge assembly in another partially folded position.

As shown in the accompanying figures, the hinge assemblies 50*a*, 50*b* may include a pivot member 70. The pivot member 70 may be used to pivotally or otherwise connect the brackets 66*a*, 666*b*. For example, the pivot member 70 may consist of a pin, rivet, rod and the like. The hinge assemblies 50*a*, 50*b* may also includes a locking member 72. The locking member 72 may be moved between a first position, such as seen in FIG. 7A, in which the locking member locks the hinge assembly 50*a*, 50*b* in the locked position and a second position, such as seen in FIGS. 7C and 7D, in which the hinge assembly can be readily moved. This may allow, for example, the table top 12 to be readily moved between the folded and unfolded configurations. The locking member 72 may be a pin, rod and the like and the locking member is preferably constructed of a relatively strong, rigid material such as metal, steel, plastic and the like. The locking member 72 preferably has a generally cylindrical shape configuration or other shape to facilitate movement of the locking member between the locked and unlocked position. It will be appreciated, however, that the locking member 72 may be constructed of various materials having suitable characteristics and it may have a number of appropriate shapes, sizes and configurations.

Figure 6:
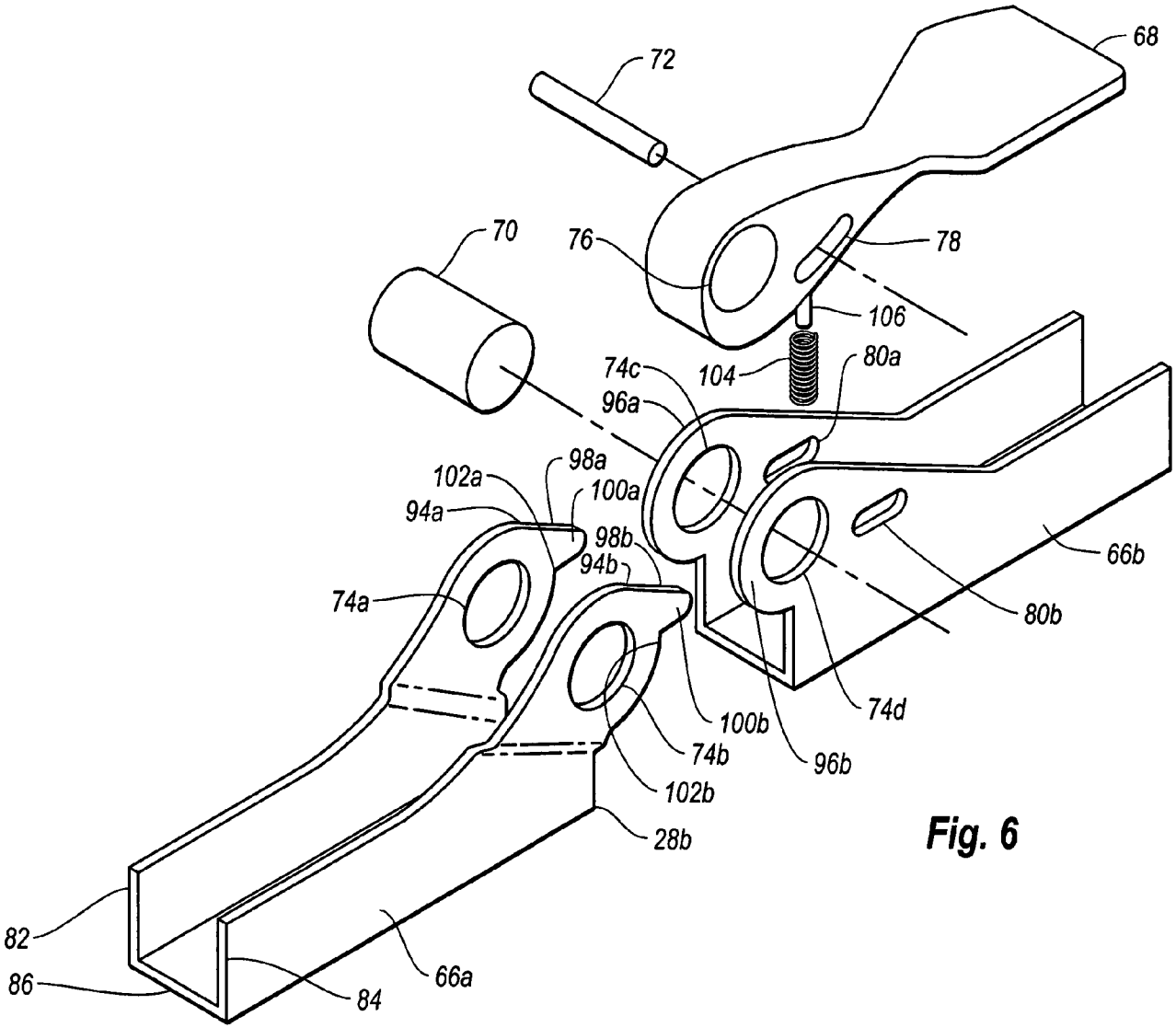
FIG. 6 is an exploded perspective view of the hinge assembly shown in FIG. 5.

In greater detail, as best seen in FIG. 6, the bracket 66*a* may include apertures 74*a*, 74*b* and the bracket 66*b* may include apertures 74*c*, 74*d*. At least a portion of the pivot member 70 is inserted into the apertures 74*a*, 74*b*, 74*c*, 74*d* to pivotally or otherwise connect the brackets 66*a*, 66*b*. The lever 68 may also include an aperture 76 and the pivot member 70 is also preferably inserted through this aperture to connect the lever to the brackets 66*a*, 66*b*. It will be appreciated that the brackets 66*a*, 66*b* and/or the lever 68 may also be connected in other suitable manners or using other appropriate means.

As shown in the accompanying figures, the brackets 66*a*, 66*b* and/or the lever 68 may be sized and configured to allow the locking member 72 to be moved among a plurality of positions. For example, as best seen in FIG. 6, the lever 68 may include an elongated aperture or slot 78 and the bracket 66*b* may include elongated locking apertures or slots 80*a*, 80*b*. As illustrated, the elongated aperture 78 preferably has a generally curvilinear shape and the elongated locking apertures 80*a*, 80*b* preferably have a generally linear shape. It will be appreciated, however, that the elongated aperture 78 and/or elongated locking apertures 80*a*, 80*b* may have other suitable shapes and sizes depending, for example, upon the size and configuration of the brackets 66*a*, 66*b* and/or locking member 72.

The elongated aperture 78 in the lever 68 is preferably aligned with the apertures 80*a*, 80*b* in the bracket 66*b* to allow the locking member 72 to be disposed in the apertures. Preferably, however, only a portion of the apertures 78, 80*a*, 80*b* are aligned at one time. In addition, the portion of the apertures 78, 80*a*, 80*b* that is aligned preferably changes as the lever 68 and the bracket 66*b* are moved relative to each other. Thus, as the location of the portion of the aligned apertures 78, 80*a*, 80*b* changes, the locking member 72 is accordingly moved. This may allow the locking member 72 to be moved among a plurality of positions within the apertures 78, 80. In particular, the locking member 72 may be moved between a first position as shown in FIG. 7A and a second position as shown in FIG. 7B. Thus, the bracket 66*b* and/or the lever 68 may be sized and configured to bias or otherwise move the locking member 72 among a plurality of positions. Further, as best seen in FIG. 6, the aperture 78 is preferably disposed at an angle with respect to the apertures 80*a*, 80*b*, which may help facilitate movement of the locking member 72 relative to the apertures 78, 80*a*, 80*b*. In addition, this angled relationship may help convert the pivotal motion of the lever 68 to generally linear motion of the pin 72 within the apertures 80*a*, 80*b*. The apertures 78, 80*a*, 80*b*, however, could have other suitable arrangements and configurations depending, for upon, upon the intended use of the hinge assembly.

As shown in FIGS. 5-7D, the bracket 66*a* may include sidewalls 82 and 84 with an intermediate wall 86 joining the sidewalls. Similarly, the bracket 66*b* may include sidewalls 88 and 90 with an intermediate wall 92 joining the sidewalls. Thus, the brackets 66*a*, 66*b* may have a generally U-shaped configuration, which may form a cavity sized and configured to receive all or at least a portion of the frame such as the side rails 46, 48. For example, at least a portion of the side rail 46, 48 may be disposed between or proximate the sidewalls 82, 84 or 88, 90. It will be appreciated that the brackets 66*a*, 66*b* may be connected to the frame in any suitable fashion. It will also be appreciated that all or a portion of the brackets 66*a*, 66*b* may be integrally formed with frame as part of a unitary, one-piece construction. Further, it will be appreciated that the brackets 66*a*, 66*b* may be connected to any suitable portions of the table top 12 or table 10.

The brackets 66*a*, 66*b* may also include one or more flanges that are sized and configured to allow the brackets 66 to be connected. For example, the bracket 66*a* may include flanges 94*a*, 94*b* and the bracket 66*b* may include flanges 96*a*, 96*b*. The flanges 94*a*, 94*b* may respectively include the apertures 74*a*, 74*b*; and the flanges 96*a*, 96*b* may include the apertures 74*c*, 74*d*. The pivot member 70 may be inserted into the apertures 74*a*, 74*b*, 74*c*, 74*d* and/or the aperture 76 in the lever 68 to connect the brackets 66 and the lever. Specifically, at least a portion of the flanges 96*a*, 96*b* are positioned proximate or between the flanges 94*a*, 94*b* to allow the apertures 74*a*, 74*b*, 74*c*, 74*d* to be aligned. In addition, at least a portion of the lever 68 is positioned between the flanges 96*a*, 96*b* to align the apertures 74*a*, 74*b*, 74*c*, 74*d* and 76. When the apertures 74*a*, 74*b*, 74*c*, 74*d* and 76 aligned, then at least a portion of the pivot member 70 may be received into the apertures. The flanges 94*a*, 94*b* may extend or flare outwardly to help receive the flanges 96*a*, 96*b*, but it will be appreciated that the flanges need not extend outwardly and that the flanges and the lever 68 may be interconnected in a variety of other positions and manners. For example, the flanges 94 and 96 could have an interchangeable configuration in which the flanges flare in the same direction. It will be understood, however, that the flanges 94, 96 do not have to extend or flare outwardly.

The flanges 94*a*, 94*b* may include outer surfaces or bearing surfaces 98*a*, 98*b*. The outer surfaces 98*a*, 98*b* are preferably sized and configured to contact or abut the locking member 72. In addition, the outer surfaces 98*a*, 98*b* may be sized and configured to contact or abut the locking member 72 as the hinge assembly is moved between the locked and unlocked positions. The flanges 94*a*, 94*b* may also include outwardly extending flanges or catches 100*a*, 100*b*. The catches 100*a*, 100*b* are preferably sized and configured to include notches 102*a*, 102*b* that are located along the outer surfaces 98*a*, 98*b*. The notches 102*a*, 102*b* preferably have a generally L-shaped configuration and the notches are preferably sized and configured to retain the locking member 72 in a generally fixed position. It will be appreciated, however, that the catches 100*a*, 100*b* and the notches 102*a*, 102*b* may have other suitable configurations and arrangements. For example, the catches 100*a*, 100*b* may consist of a protrusion, groove, recessed portion, indentation and the like that is sized and configured to receive and retain at least a portion of the locking member 72. Further, the notches 102*a*, 102*b* may consist of any suitable groove, recessed portion, indentation and the like that is sized and configured to receive and retain at least a portion of the locking member 72.

As best seen in FIGS. 6 and 7A to D, a biasing member 104, such as a spring, may bias a portion of the hinge assembly so that, for example, the hinge assembly has a tendency to remain in the same position. In particular, the biasing member 104 may be sized and configured to bias the hinge assembly to remain in the locked position. It will be understood that the biasing member 104 may also be used to bias the hinge assembly into different positions and the biasing member is not required.

In greater detail, the biasing member 104 may bias the lever 68 to help maintain the locking member 72 in one or more selected positions, such as the locked position. For example, the lever 68 may include an alignment member 106, such as an elongated post, which may facilitate attaching and/or aligning the biasing member 104 and the lever 68. The alignment member 106 may be integrally formed with the lever 68 as part of a unitary, one-piece construction or the alignment member may be a separate component that is connected to the lever 68. As best seen in FIG. 6, the biasing member 104 may be a compression type spring with a generally cylindrical configuration that is sized and configured to receive all or at least a portion of the alignment member 106. It will be appreciated that the biasing member 104 and the alignment member 106 may have a variety of other suitable constructions.

In operation, the locking member 72 may be disposed in a first, locked position, such as seen in FIG. 7A, in which the locking member locks the hinge assembly and/or the table top 12 in a generally fixed configuration. The locking member 72 may also be disposed in a second, unlocked position, such as seen in FIG. 7B, in which the hinge assembly and/or the table top 12 may be moved between an unfolded configuration and a folded configuration. When in the first, locked position, the locking member 72 preferably selectively engages at least a portion of the bracket 66*a*, such as the notches 102*a*, 102*b* of the catches 100*a*, 100*b* of the flanges 98*a*, 98*b*. Thus, as shown in FIG. 7A, the locking member 72 preferably engages the notches 102*a*, 102*b* of the catches 100*a*, 100*b*, which may prevent the brackets 66*a*, 66*b* from moving. Accordingly, this may the hinge assembly and/or the table top 12 in a generally fixed configuration.

To unlock the hinge assembly and/or the table top 12, a user may move the lever 68 from the first, locked position shown in FIG. 7A to the second, unlocked position shown in FIG. 7B. As the lever 68 is moved from the locked to the unlocked positioned, the aperture 78 and the apertures 80*a*, 80*b* may bias or otherwise move the locking member 72 to the unlocked position. As shown in FIG. 7B, the locking member 72 is disengaged from the notches 102*a*, 102*b* of the catches 100*a*, 100*b* and that may allow the hinge assembly and/or the table top 12 to be moved between the folded and unfolded configurations.

As shown in FIGS. 7A and 7B, the locked position may include the locking member 72 being disposed proximate a first end of the aperture 78 and the unlocked position may include the locking member being proximate a second end of the aperture. Likewise, the locked position may include the locking member 72 being disposed proximate a first end of the aperture 80 and the unlocked position may include the locking member being disposed proximate a second end of the aperture. It will be appreciated that the locking member 72 may be in a locked and/or unlocked position while in any suitable positions relative to the apertures 78 and 80, including, but not limited to, locations spaced apart from the ends of the apertures.

As mentioned above, the lever 68 can also be biased to maintain the locking member 72 in a selected position, such as a locked or unlocked position. Preferably, the biasing member 104 biases the lever 68 such that the locking member 72 has a tendency to remain in the locked position unless, for example, the user exerts a force on the lever. For example, the biasing member 104 may bias the lever 68 toward the locking position shown in FIG. 7A. As the user moves the lever 68 to the unlocked position shown in FIG. 7B, the lever 68 may compress the biasing member 104 and the user may hold the lever in the unlocked position shown in FIG. 7B to allow the bracket 66*a* to pivot relative to bracket 66*b*. As shown in FIG. 7C, the bracket 66*a* may pivot relative to bracket 66*b* and the user may release the lever 68, which may allow the biasing member 104 to bias the lever 68 towards the locking position. As the lever 68 moves toward the locking position, the lever may bias the locking member 72 to engage the bearing surfaces 98*a*, 98*b* of the flanges 94*a*, 94*b*, and the bearing surfaces may function as a cam, as shown in FIGS. 7C and 7D.

To lock the hinge assembly and/or the table top 12, a user may pivot or otherwise move the bracket 66*a* to the unfolded position shown in FIG. 7B. Advantageously, the lever 68, which is biased by the biasing member 104, biases the locking member 72 against the bearing surfaces 98*a*, 98*b* of the flanges 94*a*, 94*b*. As mentioned above, the bearing surfaces 98*a*, 98*b* may be sized and configured to act as a cam. Accordingly, the locking member 72 may engage the bearing surfaces 98*a*, 98*b* as the bracket 66*a* is moved towards the unfolded position. The biasing member 104 may be sized and configured to provide a generally continuous force to bias the lever 68 and/or the locking member 72 toward the locked position as the locking member engages the bearing surfaces 98*a*, 98*b*. Accordingly, the user need not manipulate the lever 68 to lock the hinge assembly and/or the table top 12. Rather, as the bracket 66*a* reaches the unfolded position, the biasing member 104 preferably biases the lever 68, which in turn biases the locking member 72 toward the locked position shown in FIG. 7A. Of course, the table 10 does not require the biasing member 104 and the user may manipulate the lever 68 to lock and/or unlock the hinge assembly and/or the table top 12 as desired.

Figure 8A:
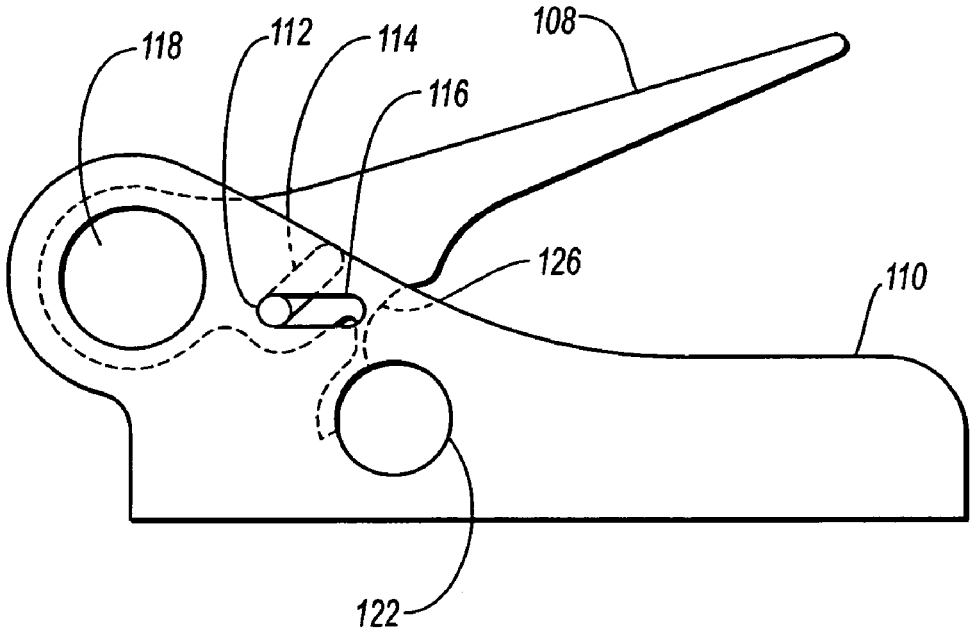
FIG. 8A is a side view of another exemplary embodiment of the hinge assembly that may be used in connection with the exemplary table shown in FIG. 1, illustrating the hinge assembly in a locked position.
Figure 8B:
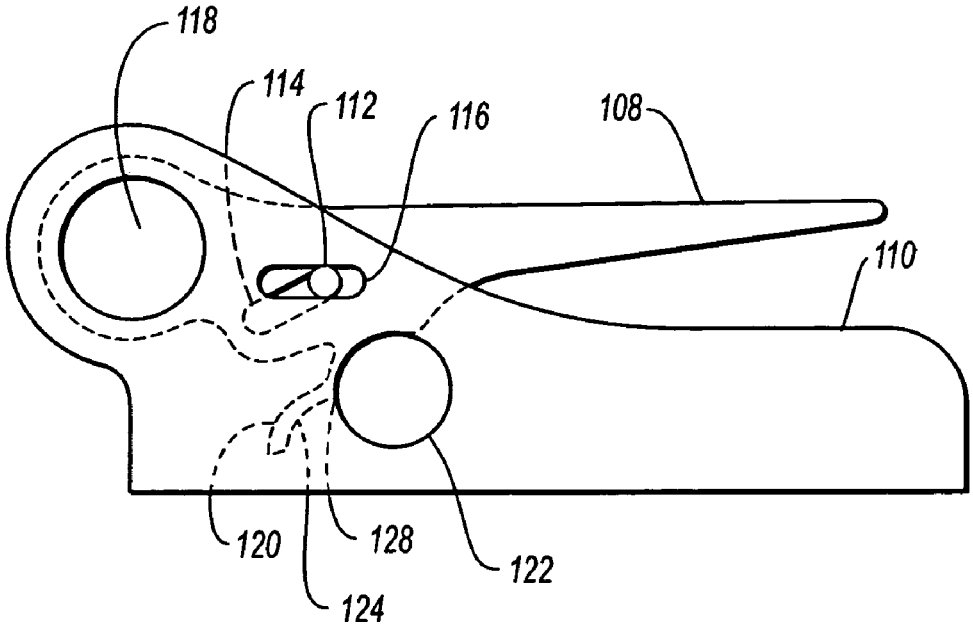
FIG. 8B is a side view of the hinge assembly shown in FIG. 8A, illustrating the hinge assembly in an unlocked position.

As discussed above, the hinge assembly may have a variety of suitable shapes, sizes and configurations. For example, another exemplary embodiment of a hinge assembly is shown in FIGS. 8A and 8B. The hinge assembly shown in FIGS. 8A and 8B may have a generally similar configuration to the hinge assembly shown in FIGS. 5 to 7D. In particular, the hinge assembly shown in FIGS. 8A and 8B may include a lever 108, a bracket 110 and a locking member 112. The lever 108 and/or the bracket 110 may be sized and configured to guide and/or move the locking member 112 among a plurality of positions in a similar manner as described above. For instance, the lever 108 may include an elongated aperture or slot 114 and the bracket 110 may include an elongated locking aperture or slot 116. Additionally, the hinge assembly may include a pivot pin 118, which may be pivotally or otherwise connected the lever 108 and/or the bracket 110.

As shown in FIGS. 8A and 8B, a biasing member 120 may be sized and configured to bias the lever 108 into one or more positions. Advantageously, the biasing member 120 may include an anchoring portion, which is sized and configured to selectively secure the lever 108 in a generally fixed position. In particular, the biasing member 120 may include one or more receiving portions that are sized and configured to selectively engage an anchoring member 122. Desirably the biasing member 120 includes a first receiving portion 124 that is sized and configured to selectively engage the anchoring member 122 and a second receiving portion 126 that is sized and configured to selectively engage the anchoring pin 122. In greater detail, as shown in FIG. 8A, the receiving portion 124 may selectively receive and engage the anchoring member 122 to selectively position the pin 112 in a locked position. Likewise, as shown in FIG. 8B, the receiving portion 126 may selectively receive and engage the anchoring member 122 to selectively position the pin 112 in a unlocked position.

The anchoring member 122 preferably has a generally circular cross sectional configuration and the first and second receiving portions 124, 126 preferably have a generally curvilinear or concave configuration that is separated by a dividing portion 128. It will be appreciated that the receiving portions 124, 126 may have various suitable shapes and sizes, such as grooves, indentations, recessed portions, notches and the like, that are sized and configured to receive and/or engage the anchoring member 122. The bracket 110 preferably includes one or more apertures that are sized and configured to receive the anchoring member 122, but it will be understood that the anchoring portion may be connected to the bracket in any suitable fashion. For example, if desired, the anchoring member 122 may be formed as part of the bracket 110 or the anchoring member may be a separate component that is attached to the bracket.

It will be appreciated that the anchoring member 122 and the receive portions 124, 126 may have a variety of suitable shapes, sizes and configurations that may be sized and configured to receive and/or engage each other. Also, it will be appreciated that the anchoring member 122 may be connected to any suitable portion of a table. Further, the biasing member 120 may be formed as part of the lever 108 or it may be a separate component. The hinge assembly may also have other suitable arrangements and configurations, such as disclosed in U.S. patent application Ser. No. 10/616,800, which was filed on Jul. 10, 2003, and entitled FOLDING TABLE, which is incorporated by reference in its entirety.

Figure 9:
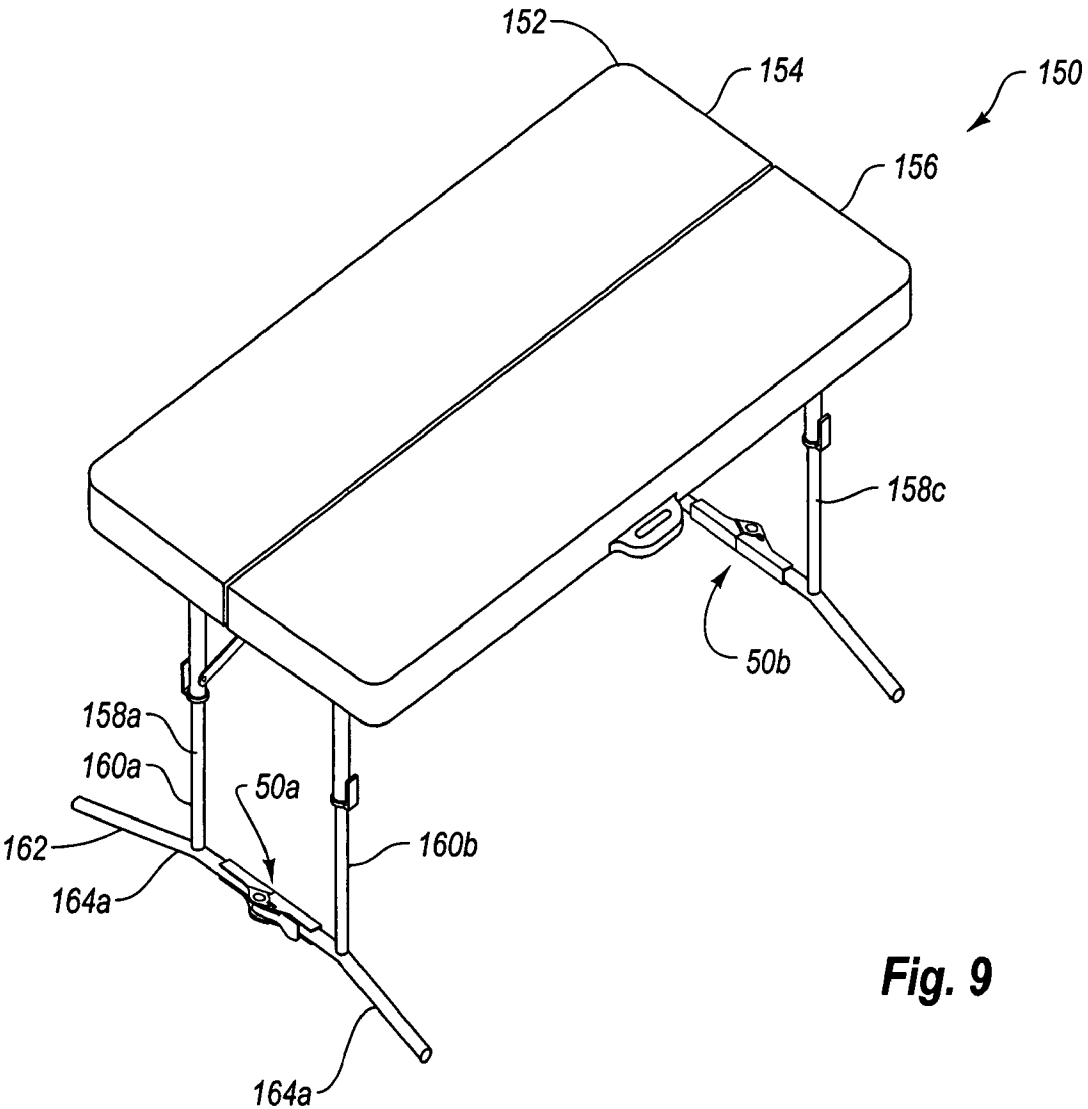
FIG. 9 is a perspective view of another exemplary embodiment of a table, illustrating a hinge assembly connected to a leg assembly.

As discussed above, the table may also have a variety of suitable configurations and arrangements. For example, as shown in FIG. 9, another exemplary embodiment of a table 150 illustrates that one or more of the hinge assemblies 50 may be connected to various portions of the table 10. In greater detail, the table 150 may include a table top 152 that includes a first section 154 and a second section 156. The table top 152 is preferably supported by two legs or leg assemblies 158*a*, 158*b*. Each of the legs or leg assemblies 158*a*, 158*b* may include two support members 160*a*, 160*b* and an elongated foot 162. The elongated foot 162 may be divided into a first portion 164*a* and a second portion 164*b*. The hinge assemblies 50*a*, 50*b* may be used to selectively lock the foot portions 164*a*, 164*b* of the leg or leg assemblies 158*a*, 158*b* in an unfolded configuration. The hinge assembles 50*a*, 50*b* may also allow the foot portions 164*a*, 164*b* of the leg or leg assemblies 158*a*, 158*b* to be moved into a folded as collapsed position. Advantageously, this may facilitate, folding of the table 150 into one or more different configurations. For example, the table 150 may be folded along its length instead of along its width. Thus, the leg or leg assemblies 158*a*, 158*b* may be folded into a collapsed position proximate or adjacent to the table top and then the hinge assembles and/or the table top may be folded into the collapsed position. It will be appreciated that the hinge assemblies 50*a*, 50*b* may be formed integrally with the foot portions 164*a*, 16*b* as part of a unitary, one-piece construction, if desired, or the hinge assemblies and foot portions may include one or more interconnected components. It will also be appreciated that the hinge assembles 50*a*, 50*b* and/or the leg or leg assemblies 158*a*, 158*b* may have other suitable configurations and arrangements depending, for example, upon the intended use or design of the table 150.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top including a first section and a second section that are movable between a folded position and an unfolded position;

a table frame including a first portion connected to the first section of the table top and a second portion connected to the second section of the table top;

a hinge assembly pivotally connecting the first section of the table top and the second section of the table top, the hinge assembly being movable between a first position in which table top is positioned in the folded position and a second position in which the table top is position in the unfolded position, the hinge assembly comprising:

a first generally U-shaped bracket including a first flange and a second flange, the first flange including an aperture and a catch, the second flange including an aperture and a catch;

a second generally U-shaped bracket including a first flange and a second flange, the first flange including an aperture and a slot, the second flange including an aperture and a slot;

a lever including an aperture and a slot;

a pivot member connecting the first bracket, the second bracket and the lever and a locking member disposed in the slot in the first flange of the second bracket, the slot in the second flange of the second bracket and the slot in the lever, the locking member being movable between a first position in which the locking member locks the hinge assembly and a second position in the hinge assembly is unlocked;

wherein the lever is sized and configured to guide the locking member between the first position and the second position.

2. The table as in claim 1, further comprising a biasing member that is sized and configured to bias at least a portion of the lever.

3. The table as in claim 2, wherein the biasing member includes an anchoring portion with a first receiving portion and a second receiving portion.

4. The table as in claim 3, wherein the first receiving portion has a generally concave configuration and the second receiving portion has a generally concave configuration.

5. The table as in claim 2, wherein the biasing member is a compression spring.

6. The table as in claim 2, wherein the first bracket is formed integrally with the first portion of the frame as part of a unitary, one-piece construction; and wherein the second bracket is formed integrally with the second portion of the frame as part of a unitary, one-piece construction.

7. A table comprising:

a table top including a first section and a second section that are movable between a folded position and unfolded position;

a frame connected to the table top, the frame including a first portion connected to the first section of the table top and a second portion connected to the second section of the table top;

a hinge assembly pivotally connecting the first section and the second section of the table top, the hinge assembly comprising:

a first bracket connected to the first portion of the frame, the first bracket including a first flange and a second flange, the first flange including an aperture, a catch and a notch, the second flange including an aperture, a catch and a notch;

a second bracket connected to the second portion of the frame, the second bracket including a first flange and a second flange, the first flange including an aperture and a slot, the second flange including an aperture and a slot;

a locking member disposed in the slot in the first flange of the second bracket and in the slot in the second flange of the second bracket, the locking member being movable between a locked position in which the table top may be locked in a fixed position and an unlocked position in which the table top may be moved between the folded position and the unfolded position;

a lever at least partially disposed between the first flange and the second flange of the first bracket and between the first flange and the second flange of the second bracket, the lever including a slot and the locking member being disposed in the slot, the lever being sized and configured to move the locking member between the locked position and the unlocked position; and a pivot member pivotally connecting the first bracket, the second bracket and the lever; and one or more legs that are sized and configured to support the table top above a support surface.

8. The table as in claim 7, wherein the pivot member is disposed in the aperture in the first flange of the first bracket, the aperture in the second flange of the first bracket, the aperture in the first flange of the second bracket, the aperture in the second flange of the second bracket and in an aperture in the lever.

9. The table as in claim 7, wherein the slot aperture in the lever has a generally curvilinear shape; and wherein the slot in the first flange of the second bracket and the slot in the second flange of the second bracket have a generally linear shape.

10. The table as in claim 7, wherein the notch in the first flange of the first bracket and the notch in the second flange of the first bracket are sized and configured to receive and retain the locking member in a generally fixed position.

11. The table as in claim 7, wherein only a portion of the slot in the lever, the slot in the first flange of the second bracket and the slot in the second flange of the second bracket are generally aligned at one time; and wherein the portion of the slot in the lever, the slot in the first flange of the second bracket and the slot in the second flange of the second bracket that is generally aligned changes as the lever is moved.

12. The table as in claim 7, wherein the slot in the lever includes a first end and a second end, the slot in the first flange of the second bracket includes a first end and a second end, and the slot in the second flange of the second bracket includes a first end and a second end.

13. The table as in claim 7, further comprising a biasing member that is sized and configured to bias the lever into the locked position.

14. The table as in claim 7, further comprising a biasing member that is sized and configured to bias the lever into the unlocked position.

15. The table as in claim 7, further comprising a biasing member that includes a first position and a second position, the biasing member being disposed in the first position when the locking member is in the unlocked position.

16. The table as in claim 7, further comprising a biasing member that includes a first position and a second position, the biasing member being disposed in the second position when the locking member is in the locked position.

17. The table as in claim 7, wherein the first bracket has a generally U-shaped configuration with the first flange extending outwardly from a first sidewall and the second flange extending outwardly from a second sidewall; and wherein the second bracket has a generally U-shaped configuration with the first flange extending outwardly from a first sidewall and the second flange extending outwardly from a second sidewall.

* * * * *

UNITED STATES PATENT AND TRADEMARK OFFICE

CERTIFICATE OF CORRECTION

PATENT NO. : 7,461,601 B2 
APPLICATION NO. : 11/134816
DATED : December 9, 2008
INVENTOR(S) : Jin et al.

It is certified that error appears in the above-identified patent and that said Letters Patent is hereby corrected as shown below:

Drawings

Sheet 9, please replace the current drawing of FIG. 9 with the following figure in which "leg assembly 158b" and "second portion 164b" have been appropriately labeled

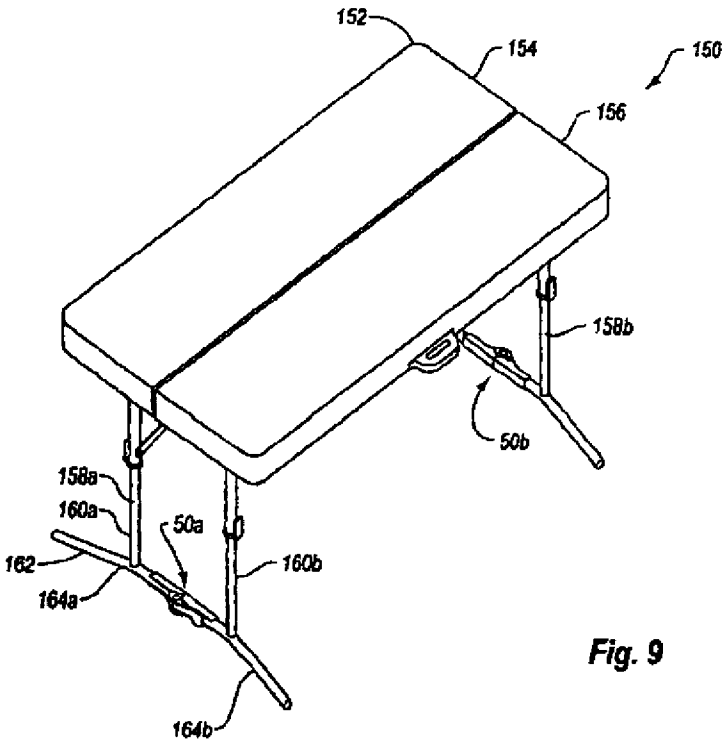

Fig. 9

Column 1

Line 62, change "required" to --required to move--

Column 2

Line 1, change "also a" to --also include a--

Column 5

Line 1, change "embodiment" to --embodiment of--

Column 6

Line 26, change "that" to --than--

Column 8
Line 10, change "lip" to --lip 28--
Line 13, change "lip" to --lip 28--

Column 10
Line 50, change "LEQ" to --LEG--
Line 55, change "first" to --first end--

Column 11
Line 14, change "handles" to --handle--
Line 21, change "section" to --second--
Line 29, change "666b" to --66b--

Column 12
Line 30, change the first "upon" to --example--

Column 13
Line 66, change "may" to --may maintain--

Column 15
Line 64, change "50" to --50a, 50b--
Line 65, change "10" to --150--

Column 16
Line 20, change "16b" to --164b--

Signed and Sealed this

Thirteenth Day of April, 2010

David J. Kappos

David J. Kappos
*Director of the United States Patent and Trademark Office*